US005950990A

United States Patent [19]

Castillo

[11] Patent Number: 5,950,990

[45] Date of Patent: Sep. 14, 1999

[54] ATTACHMENT FOR AUTOMATICALLY OPERATING A SCISSORS JACK

[76] Inventor: Victor Castillo, 1080 N.E. 24th Ave., Pompano Beach, Fla. 33062

[21] Appl. No.: 09/065,333

[22] Filed: Apr. 23, 1998

[51] Int. Cl.[6] ..... B66F 3/08

[52] U.S. Cl. ..... 254/126

[58] Field of Search ..... 254/103, 122, 254/126, DIG. 2, DIG. 3; 81/176.1, 176.15, 176.2

[56] References Cited

U.S. PATENT DOCUMENTS 4,749,169 6/1988 Pickles .
4,872,230 10/1989 Levine .
4,943,034 7/1990 Wagnon .
5,085,407 2/1992 Lonon ..... 254/103
5,158,266 10/1992 Alten .
5,165,660 11/1992 Engel et al. .
5,364,072 11/1994 Engel .
5,707,043 1/1998 Yoshida ..... 254/126

*Primary Examiner*—Robert C. Watson
*Attorney, Agent, or Firm*—Kenneth L Tolar

[57] ABSTRACT

The present invention relates to an attachment device for securing to a conventional screw jack allowing the screw jack to be operated with a power tool. The device comprises a cylindrical shaft having first and second ends with a transverse bore proximal a first end thereof. Received within the transverse bore is a tubular member having two opposing ends with a clamp member pivotally attached to an end thereof. Attached to a second end of a cylindrical shaft is an engagement member dimensioned to lockably engage a drive member on a power tool. Accordingly, the tubular member may be secured to a handle bracket on a conventional screw jack and the shaft may be rotated with a power tool to automatically raise or lower the jack.

4 Claims, 1 Drawing Sheet

ATTACHMENT FOR AUTOMATICALLY OPERATING A SCISSORS JACK

BACKGROUND OF THE INVENTION

The present invention relates to an attachment for coupling with a conventional jack handle bracket which allows the jack to be raised or lowered with a power tool.

DESCRIPTION OF THE PRIOR ART

A conventional scissors jack generally comprises a plurality of collapsible arms having a lift platform on its upper surface for engaging the lower surface of the vehicle. To lift a vehicle, the arms may be gradually expanded to a diamond shaped configuration to raise the platform by manually rotating a handle secured to an elongated screw. However, the elderly and similarly incapacitated people often do not have the strength or stamina to rotate the handle with sufficient force and duration to adequately raise the vehicle. Accordingly, there is currently a need for a device that eliminates the need for rotating a conventional jack handle as described above.

Although motor driven devices for operating a screw jack exist, they include numerous interrelated components which are difficult to assemble and store. Numerous other scissor jack assemblies and attachments therefor also exist in the prior. However, none of these devices relate to a convenient, easy to manufacture attachment that allows the jack to be operated with a power tool. For example, U.S. Pat. No. 5,364,072 issued to Engel discloses a screw designed for a scissors jack that does not extend beyond the confines of the jack when it is in a partially raised position so as to reduce the space required to store the jack.

U.S. Pat. No. 5,165,660 issued to Engel et al discloses a drive unit for a jack bent to form a thumb and finger handle for manually turning the jack and also to provide an opening for receiving the end of a crank handle.

U.S. Pat. No. 5,158,266 issued to Alten discloses a scissors type vehicle jack operable with a rotating handle.

U.S. Pat. No. 4,943,034 issued to Wagnon discloses an adaptor for a jack having a threaded shaft that is rotated with a motor and which may be threadedly coupled with the jack shaft drive screw.

U.S. Pat. No. 4,872,230 issued to Levine discloses an electrically powered automobile jack and nut remover.

U.S. Pat. No. 4,749,169 issued to Pickles discloses a portable powered screw jack actuator unit.

As indicated above, none of the prior art devices relate to a compact, easy to use attachment for a scissors jack which allows the jack to be operated with a portable power tool.

SUMMARY OF THE INVENTION

The present invention relates to an attachment for a conventional scissors jack allowing the jack to be operated with a power tool. The device comprises a cylindrical shaft having two opposing ends with a cylindrical transverse bore proximal a first end thereof. Received within the bore is a tubular member which may be secured to a handle bracket on a conventional jack. A clamping device is pivotally attached to an end of the tubular member to secure the attachment to the bracket. At a second end of the shaft is an engagement member configured to mate with a drive member on a power tool. In the preferred embodiment, the engagement member resembles a hexagonal nut which may be rotatably driven with a hexagonal socket on a power drill to automatically raise or lower the jack. It is therefore an object of the present invention to provide an attachment for a scissors jack which eliminates the burdensome and strenuous task of manually rotating a handle in order to manipulate the jack.

It is yet another object of the present invention to provide an attachment for a scissors jack that is easy to use and inexpensive to manufacture.

It is yet another object of the present invention to provide an attachment for a scissors jack which may be quickly and reliably secured thereto. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
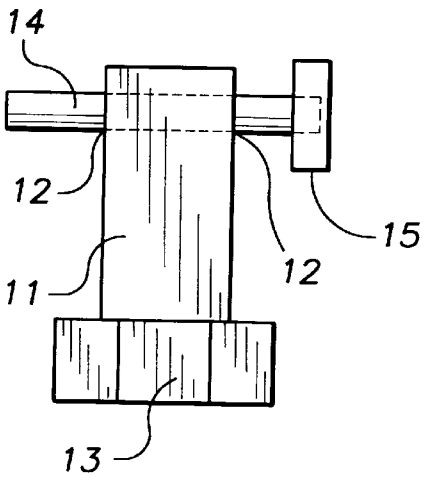
FIG. 2 is a side view of the inventive device.
Figure 1:
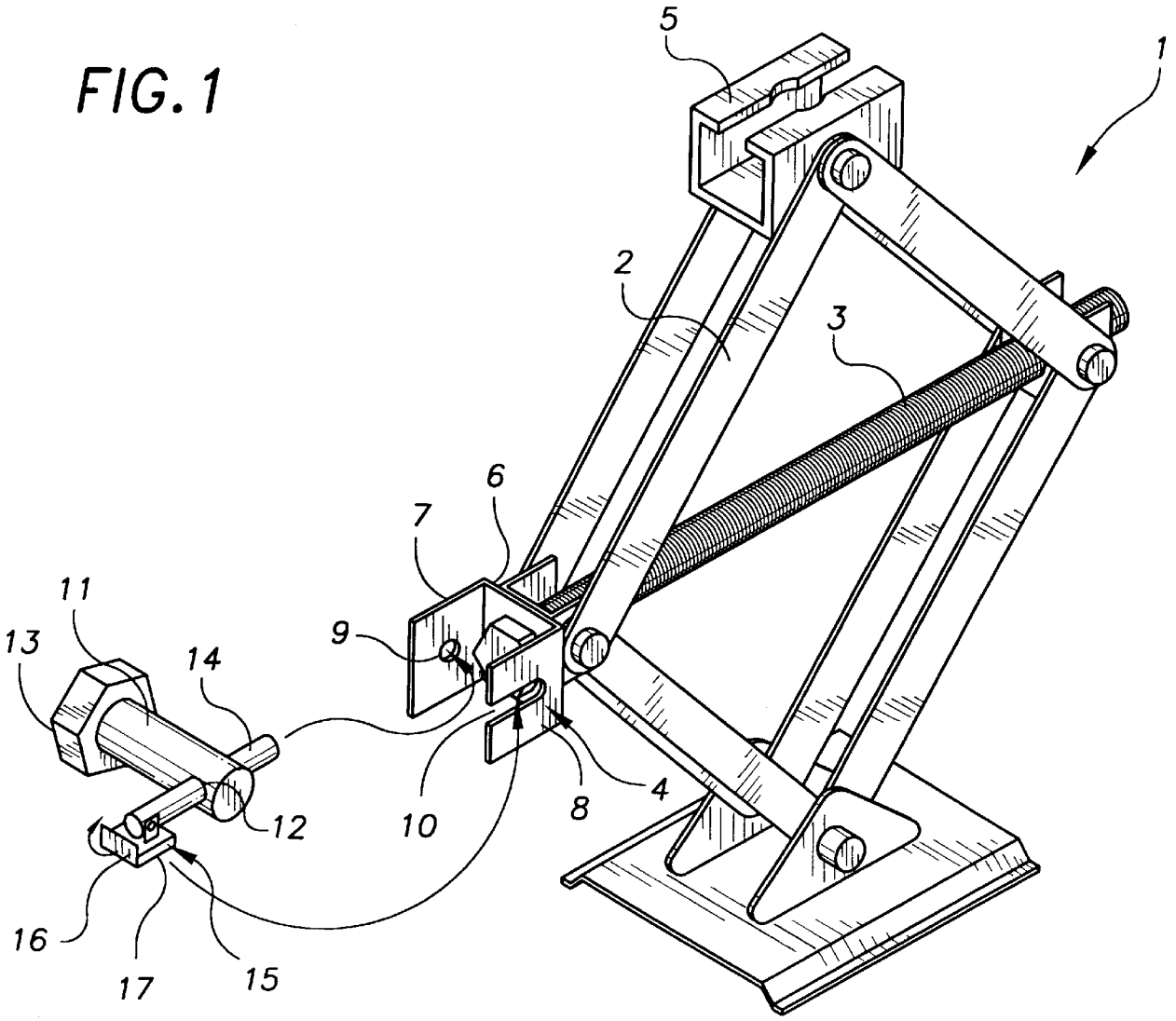
FIG. 1 depicts the inventive device offset from a conventional scissors jack.

Referring now to FIGS. 1 and 2, the present invention relates to an attachment device for securing to a conventional scissors jack 1 allowing the scissors jack to be operated with a power tool. A conventional scissors jack 1 generally includes four arms 2 pivotally attached at each end to an adjacent arm to form a four sided, collapsible support structure. A lift platform 5 is secured to the top of the support structure which engages the lower surface of a vehicle. The jack is operable between its fully extended and collapsed positions by manually rotating an elongated, horizontal screw 3. The screw is rotated with a handle member (not pictured) secured to an attachment bracket 4 at a first end thereof.

A common handle attachment bracket is depicted in FIG. 1 and is substantially U-shaped having an end wall 6 secured to an end of the screw with a pair of opposing planar parallel side walls 7,8 horizontally depending therefrom. A first sidewall 7 has an aperture 9 therethrough and the opposing sidewall 8 has a horizontal, arcuate 10 slot. The aperture and slot receive the elongated handle member to rotate the bracket and screw in a desired direction.

The present invention relates to an attachment for securing to a conventional scissors type screw jack bracket as described above that eliminates the task of manually rotating a handle. The device comprises a cylindrical shaft 11 having first and second ends with a transverse bore 12 at a first end thereof At a second end is an engagement member 13 having a configuration matable with a drive member on a power tool. In the preferred embodiment, the engagement member resembles a hexagonal nut for engaging a hexagonal socket secured to a power drill. However, as will be readily apparent to those skilled in the art, the engagement member may resemble a square or octagonal nut, a phillips or flat screw head or any other similar item which may be conveniently operated with a power tool.

Received within the transverse bore is a tubular member 14 having two opposing ends with a clamp member 15 pivotally attached to an end thereof. The clamp member includes a substantially square or rectangular panel 17 with a flange 16 perpendicularly depending from an edge thereof The clamp may be pivoted to a vertical position with the panel abutting the outwardly facing surface of the bracket wall 8 and the flange 16 engaging an edge thereof to secure the device to the handle bracket.

Accordingly, the device may be quickly secured to a jack handle bracket by inserting the end of the tubular member opposite the clamp into the aperture on the first side wall. The portion of the tubular member proximal the clamp is slid within the slot on the opposing wall and the clamp is pivoted to a vertical position with its flange engaging the top edge of the wall. A socket or similar drive member having an identical configuration as the engagement member is secured to a reversible, battery operated power tool such as a drill, preferably one that may be operated via the vehicle cigarette lighter. The drive member is then secured to the engagement member so that the power tool may raise or lower the jack as desired.

The above described device is not to be limited to the exact details of construction enumerated above. For example, the drive member is described as a hexagonal nut but may relate to any similar device which may selectively couple with a socket or a drive member on a power tool. The various components of the present invention are preferably manufactured with steel or stainless steel. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a screw jack assembly selectively operable with an elongated horizontal screw having a handle bracket at an end thereof, said handle bracket including a pair of opposing planar walls, a first of which has an aperture therethrough, a second wall having a slot, an attachment for operating said screw jack with a power tool comprising:

a cylindrical shaft having first and second ends with a transverse bore at a first end thereof;

an engagement member secured to a second end of said shaft, said engagement member configured to engage a drive member on a power tool;

means for securing said attachment to said bracket.

2. A device according to claim 1 wherein said engagement member is configured to resemble a hexagonal nut.

3. A device according to claim 1 wherein said means for securing said attachment to said bracket comprises a clamp member pivotally secured to a first end of said tubular member.

4. A device according to claim 3 wherein said clamp member includes a substantially planar rectangular panel having an integral flange perpendicularly depending from an edge thereof for engaging the top edge of a bracket sidewall.

* * * * *